US009695827B2

(12) United States Patent
Araki et al.

(10) Patent No.: US 9,695,827 B2
(45) Date of Patent: Jul. 4, 2017

(54) CONTROL DEVICE FOR ELECTRIC WATER PUMP

(75) Inventors: Yukari Araki, Chiryu (JP); Osamu Shintani, Toyota (JP); Takasuke Shikida, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 203 days.

(21) Appl. No.: 14/115,809

(22) PCT Filed: Jun. 22, 2011

(86) PCT No.: PCT/JP2011/064252

§ 371 (c)(1),
(2), (4) Date: Nov. 5, 2013

(87) PCT Pub. No.: WO2012/176292

PCT Pub. Date: Dec. 27, 2012

(65) Prior Publication Data

US 2014/0093393 A1 Apr. 3, 2014

(51) Int. Cl.

| | |
|---|---|
| ***F04D 15/00*** | (2006.01) |
| ***F01P 11/16*** | (2006.01) |
| ***F01P 5/12*** | (2006.01) |
| ***F01P 7/16*** | (2006.01) |

(Continued)

(52) U.S. Cl.

CPC ..... *F04D 15/0094* (2013.01); *F01P 5/12* (2013.01); *F01P 7/16* (2013.01); *F01P 7/164* (2013.01); *F01P 11/16* (2013.01); *F01P 11/18* (2013.01); *F04D 15/0066* (2013.01);

(Continued)

(58) Field of Classification Search

CPC .. F04D 15/0094; F04D 15/0066; F01P 11/16; F01P 2025/30; F01P 5/12; F01P 7/08; F01P 7/16; F01P 7/164; F04B 49/02

See application file for complete search history.

(56) References Cited

U.S. PATENT DOCUMENTS

| | | | | |
|---|---|---|---|---|
| 4,644,909 | A * | 2/1987 | Nishikata | F01P 7/16 123/41.1 |
| 6,230,553 | B1 | 5/2001 | Uchiyama et al. | |
| 8,281,753 | B2 | 10/2012 | Shintani et al. | |

(Continued)

FOREIGN PATENT DOCUMENTS

| | | | |
|---|---|---|---|
| CN | 1598262 | A | 3/2005 |
| DE | 102013224398 | A1 | 10/2014 |

(Continued)

*Primary Examiner* — Dominick L Plakkoottam
(74) *Attorney, Agent, or Firm* — Oliff PLC

(57) ABSTRACT

In an electric water pump for circulating cooling water of an engine mounted on a vehicle or similar, a time interval to switch energized phase of a pump motor is set to longer than a time interval during a normal flow rate control (during a flow rate control at a flow rate equal to or more than a flow rate where an electromotive force generated at a non-energized phase is detectable). In the case where a pump discharge pressure (or a water temperature of the cooling water) repeatedly increases and decreases in this extremely low flow rate state, it is determined that the electric water pump normally rotates as required. This allows providing the extremely low flow rate state between a water stop state and a water circulation state in a control for stop of water in an engine cooling system.

5 Claims, 9 Drawing Sheets

(51) Int. Cl.
*F01P 11/18* (2006.01)
*F04B 49/02* (2006.01)

(52) U.S. Cl.
CPC ..... *F01P 2005/125* (2013.01); *F01P 2037/02* (2013.01); *F01P 2060/08* (2013.01); *F04B 49/02* (2013.01)

(56) References Cited

U.S. PATENT DOCUMENTS

| | | | | |
|---|---|---|---|---|
| 9,242,548 | B2 | 1/2016 | Nam et al. | |
| 2005/0061263 | A1* | 3/2005 | Lee | F01P 7/167 123/41.1 |
| 2009/0088957 | A1* | 4/2009 | Yamada | F02P 5/1521 701/111 |
| 2009/0269211 | A1* | 10/2009 | Matsutani | F04B 49/02 417/44.1 |
| 2012/0306416 | A1* | 12/2012 | Hano | B60L 1/003 318/400.26 |
| 2013/0069571 | A1* | 3/2013 | Okamoto | H02P 6/182 318/400.11 |
| 2013/0069575 | A1* | 3/2013 | Hano | H02P 6/165 318/400.34 |
| 2013/0255600 | A1* | 10/2013 | Teraya | B60K 6/445 123/41.02 |
| 2014/0093393 | A1* | 4/2014 | Araki | F01P 5/12 417/12 |

FOREIGN PATENT DOCUMENTS

| | | |
|---|---|---|
| EP | 2 108 077 B1 | 10/2009 |
| JP | A-10-210783 | 8/1998 |
| JP | A-2001-090537 | 4/2001 |
| JP | A-2002-276362 | 9/2002 |
| JP | A-2005-233044 | 9/2005 |
| JP | A-2006-336626 | 12/2006 |
| JP | A-2008-180160 | 8/2008 |
| JP | A-2009-033823 | 2/2009 |
| JP | A-2009-103000 | 5/2009 |
| JP | A-2009-185726 | 8/2009 |
| JP | A-2010-216386 | 9/2010 |
| WO | WO 2008/091027 A2 | 7/2008 |
| WO | WO 2009/013982 A1 | 1/2009 |

* cited by examiner

FIG.3A WATER STOP STATE OF COOLING SYSTEM (AT LOW TEMPERATURE)
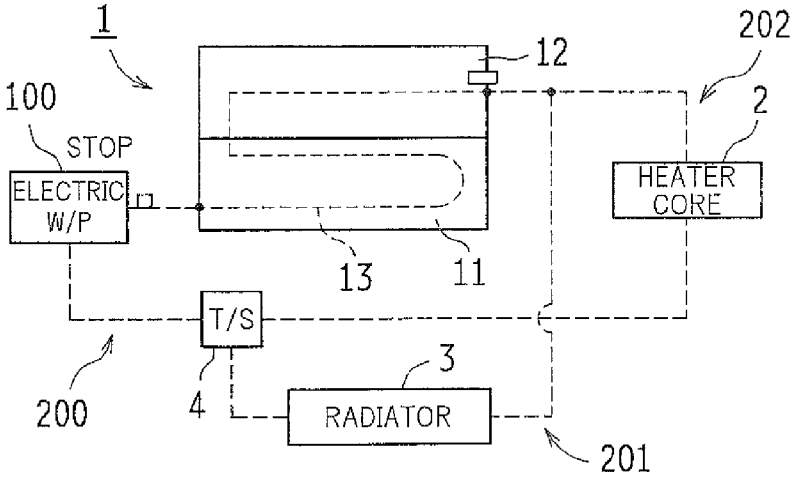
FIG.3B EXTREMELY LOW FLOW RATE CONTROL AND WATER CIRCULATION STATE OF HEATER SYSTEM
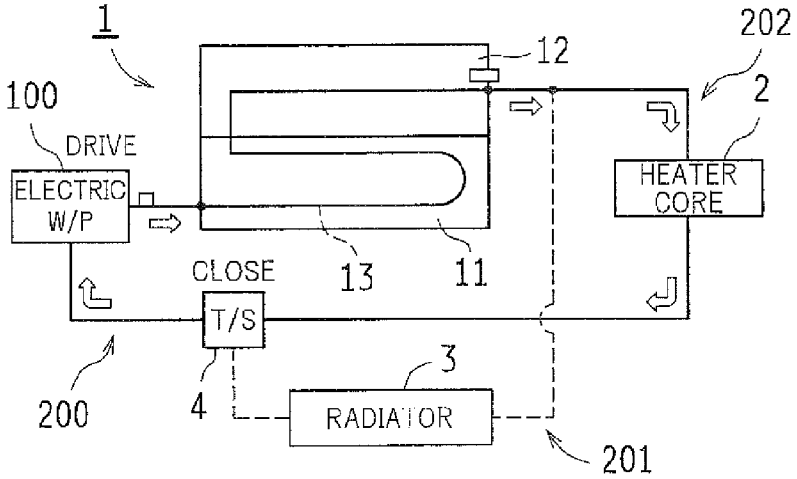
FIG.3C COMPLETE WARM-UP
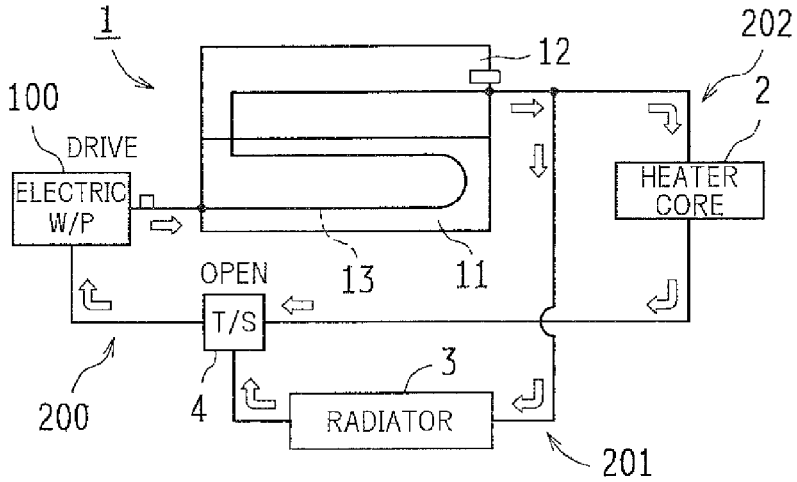

CONTROL DEVICE FOR ELECTRIC WATER PUMP

TECHNICAL FIELD

The present invention relates to a control device for an electric water pump that circulates cooling water of an engine (an internal combustion engine) mounted on a vehicle or similar.

BACKGROUND ART

In an engine mounted on a vehicle or similar, a water jacket is disposed on an internal combustion engine (a cylinder head and a cylinder block) as a coolant passage. Cooling water (such as LLC: Long Life Coolant) is circulated through a water jacket by a water pump to cool (warm up) the entire engine.

The water pump of a cooling apparatus for this engine employs a mechanical water pump that increases a discharge amount corresponding to an engine speed. Nowadays, an electric water pump is also used.

In a cooling apparatus of an engine using an electric water pump, the electric water pump is stopped in the case where a water temperature is low, for example, during an engine warm-up operation (at the engine start) so as to stop circulation of the cooling water inside of the engine (inside of the water jacket) (so as to stop the water in the engine cooling system). This accelerates the warm-up of the engine (for example, see Patent Literature 1). In the control for stop of water in the engine cooling system, for example, a temperature of the cooling water inside of the engine is detected or estimated. The stop of water in the engine cooling system ends before the water temperature of the cooling water reaches an overheat temperature of the engine, so as to transit to a water circulation state.

CITATION LIST

Patent Literature

Patent Literature 1: Japanese Unexamined Patent Application Publication No. 2010-216386

Patent Literature 2: Japanese Unexamined Patent Application Publication No. 2009-033823

SUMMARY OF INVENTION

Technical Problem

One problem of the control for the stop of water in the engine cooling system is a heat shock and a reduction in fuel efficiency (fuel consumption rate) that are caused by a cold cooling water flowing through the engine during the transition from a water stop state to a water circulation state. Simply providing an extremely low flow rate state between the water stop state and the water circulation state prevents these. However, the extremely low flow rate cannot be ensured by control of the conventional electric water pump. This point will be described below.

First, the electric water pump employs, for example, a three-phase DC motor. In the three-phase DC motor, only one phase to be energized (for example, U-phase) is energized among the phases to be energized (a stator coil) of the three phases (U-phase, V-phase, and W-phase) at the start of motor driving such that the pole positions of the rotor are aligned (N-pole of the rotor is attracted by energization of U-phase). Energization of each phase to be energized is sequentially switched from this state (to V-phase, W-phase, U-phase, V-phase . . . in this order) such that the rotor rotates. In this switching control for the energized phase, a positional change of the rotor is detected based on an electromotive force (an induced voltage) generated at a non-energized phase (a non-energized stator coil). A feedback control is performed such that a motor rotational speed (a rotational speed of the rotor per unit time) obtained from this detected value becomes a target value (a required rotational speed).

In this control for the electric water pump, in the case where a speed (a speed of a magnetic flux of the rotor to cut the coil) of the rotor pole passing the non-energized phase (the stator coil) is slow since the rotor rotates slowly, an electromotive force generated at the non-energized phase becomes small. Therefore, the electromotive force is not detectable and it cannot be determined whether or not the rotor (the electric water pump) rotates as required. Accordingly, the flow rate of the electric water pump cannot be set to a flow rate lower than the minimum flow rate with the detectable electromotive force. This does not allow controlling the electric water pump at an extremely low flow rate.

The present invention has been made in view of the above-described circumstances, and it is an object of the present invention to provide a control device for an electric water pump that allows a normal determination of a pump in a low rotation range where an electromotive force generated at a non-energized phase of an electric motor is not detectable.

Solutions to the Problems

The present invention has a technical feature in that a control device for an electric water pump used for circulating cooling water through a cooling system of an engine includes a rotation determining unit. The rotation determining unit is configured to determine that the electric water pump rotates as required in a case where one of a discharge pressure of the electric water pump and a water temperature of the cooling water repeatedly increases and decreases.

According to the present invention, for example, it is determined whether or not a discharge pressure of the electric water pump or a water temperature of the cooling water repeatedly increases and decreases in the case where a circulation flow rate of cooling water by the electric water pump is equal to or less than a predetermined flow rate or in the case where a pump duty ratio (an energization duty ratio) is equal to or less than a predetermined value. In the case where an affirmative determination is made as a determination result (in the case where the discharge pressure or water temperature repeatedly increases and decreases), it is determined that the electric water pump properly rotates as required. On the other hand, in the case where the discharge pressure of the electric water pump or the water temperature of the cooling water does not repeatedly increase and decrease, it is determined that the electric water pump does not rotate.

Accordingly, the rotation determination using the discharge pressure of the electric water pump or the water temperature of the cooling water allows a normal determination of the electric water pump in a low rotor rotation range where the electromotive force generated at the non-energized phase is not detectable. The reason will be described below.

First, in the motor of the electric water pump, a time interval to switch the energized phase has an inverse proportional relationship with a rotational speed of the rotor. Setting a longer time interval to switch the energized phase reduces the rotor speed, that is, the pump rotational speed.

As described above, in an electric water pump that includes a motor rotated by switching the energized phase, in the case where the electric water pump actually rotates corresponding to a rotation request, a phenomenon appears. In this phenomenon, a pump discharge pressure repeatedly increases and decreases. That is, a force to pull the rotor in a rotation direction by switching the energized phase becomes maximum at the time the energized phase is switched, then decreases sequentially, and becomes maximum again at the time the next energized phase is switched. This operation is repeated. Therefore, the pump discharge pressure also increases and decreases repeatedly (see FIG. 5). On the other hand, in the case where the rotor does not rotate despite receiving the drive request, hunting of the pump discharge pressure does not occur.

It is difficult to recognize the hunting of the pump discharge pressure during the normal flow rate control (in the case where the energized phase is switched at high speed). However, the hunting of the pump discharge pressure can be recognized by setting a sufficiently long time interval to switch the energized phase. That is, a longer time interval to switch the energized phase causes a longer hunting cycle. Therefore, the hunting of the pump discharge pressure is likely to be easily recognized. This allows recognizing the hunting of the pump discharge pressure even in the case where a time interval to switch the energized phase is set sufficiently longer (a rotor speed is set sufficiently smaller) than that during the normal flow rate control.

This allows recognizing existence of the hunting of the discharge pressure even in the low rotor rotation range where the electromotive force generated at the non-energized phase is not detectable. In the case where the hunting of the discharge pressure occurs, it can be determined that the electric water pump properly rotates as required. On the other hand, in the case where the hunting of the discharge pressure does not occur, it can be determined that the electric water pump is abnormal.

Also use of a water temperature of the cooling water allows a normal determination of the electric water pump in the low rotor rotation range where the electromotive force generated at the non-energized phase is not detectable. This point will be described below.

First, in the above-described control for the stop of water in the engine cooling system, when the electric water pump is driven in the water stop state, cold cooling water from the outside of the engine flows into cooling water at a high temperature inside of the engine (inside of the water jacket). At this time, in the case where the flow rate of the electric water pump is an extremely low flow rate, the hunting of the pump discharge pressure causes variation in flow rate of the cooling water (the cold cooling water) flowing into the engine. Thus, the water temperature inside of the engine repeatedly falls (decreases) and rises (increases) (see FIG. 8). This hunting of the water temperature can also be recognized by a similar reason to the case of the hunting of the discharge pressure. Accordingly, also in this case, the existence of the hunting of the water temperature is determined in the low rotor rotation range where the electromotive force generated at the non-energized phase is not detectable. This allows determining whether or not the electric water pump normally rotates as required.

As described above, the present invention allows determining whether or not the electric water pump normally rotates in the low rotor rotation range where the electromotive force generated at the non-energized phase is not detectable. This ensures the extremely low flow rate control that is impossible by the conventional control. Accordingly, in the control for the stop of water in the engine cooling system, this allows providing an extremely low flow rate state between the water stop state and the water circulation state. As a result, this effectively reduces heat shock during the transition from the water stop state to the water circulation state and maintains a large effect in fuel efficiency.

Here, according to the present invention, rotation determination of the electric water pump may be performed in the case where a circulation flow rate of cooling water by the electric water pump is equal to or less than a predetermined flow rate (the minimum flow rate controllable by the conventional control). Energization of the electric water pump is controlled by duty control, and the rotation determination of the electric water pump may be performed in the case where a duty ratio of the duty control is equal to or less than a predetermined value (the minimum duty ratio controllable by the conventional control).

According to the present invention, the electric water pump includes a rotor and a stator. The rotor includes an impeller. The stator includes a plurality of phases of coils disposed at a periphery of the rotor. The electric water pump is configured to rotate the rotor by switching the energized phase in the coils of the stator. A time interval to switch the energized phase is set longer than a time interval during a normal control (during a flow rate control at a flow rate equal to or more than a flow rate where the electromotive force generated at the non-energized phase is detectable) and then the rotation determination of the electric water pump is performed. More specifically, the time interval to switch the energized phase is set longer to an extent that a phenomenon occurs. The phenomenon is that one of a discharge pressure of the electric water pump and a water temperature of the cooling water repeatedly increases and decreases in the phenomenon. Subsequently, the rotation determination of the electric water pump is performed.

Advantageous Effects of Invention

The present invention allows a normal determination of the electric water pump in a lower rotation range than the minimum rotational speed where the electromotive force generated at the non-energized phase by the rotor rotation is detectable. This ensures the extremely low flow rate control. This provides the extremely low flow rate state between the water stop state and the water circulation state in the control for the stop of water in the engine cooling system.

BRIEF DESCRIPTION OF DRAWINGS

FIGS. 3(*a*) to 3(*c*) are diagrams each illustrating a flow (including a stop state of the cooling system) of cooling water in the cooling apparatus of FIG. 1.

DESCRIPTION OF EMBODIMENTS

Figure 1:
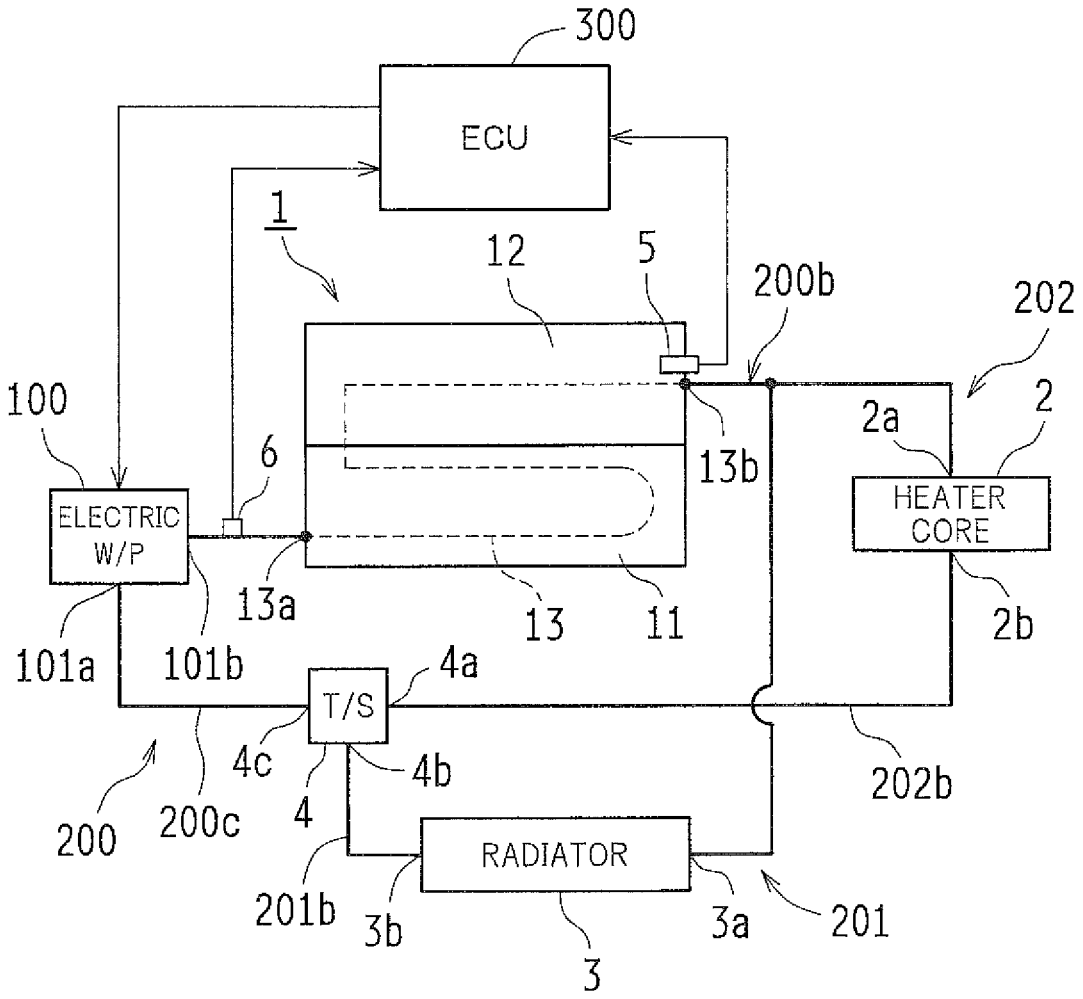
FIG. 1 is a schematic configuration diagram illustrating an exemplary cooling apparatus for an engine.

Hereinafter, a description will be given of an embodiment of the present invention by referring to the accompanying drawings.

First, a description will be given of a cooling apparatus that includes an electric water pump to which the present invention is applied by referring to FIG. 1.

The cooling apparatus in this example is a cooling apparatus for an engine mounted on a hybrid vehicle for example. This cooling apparatus includes an electric water pump (electric W/P) 100, a heater core 2, a radiator 3, a thermostat (T/S) 4, a cooling water circulation passage 200 for circulating cooling water through these instruments, and similar member.

The cooling water circulation passage 200 includes a radiator circulating system passage 201 and a heater circulating system passage 202. The radiator circulating system passage 201 circulates cooling water (LLC) through an engine 1 (a water jacket 13), the radiator 3, and the thermostat 4. The heater circulating system passage 202 circulates cooling water through the engine 1 (the water jacket 13), the heater core 2, and the thermostat 4. In this example, one electric water pump 100 is used in both the cooling water circulation of the radiator circulating system passage 201 and the cooling water circulation of the heater circulating system passage 202.

The engine 1 is, for example, a gasoline engine or a diesel engine mounted on a hybrid vehicle, and includes a cylinder block 11 and a cylinder head 12. The water jacket 13 is formed inside of the cylinder block 11 and the cylinder head 12. The engine 1 also includes a water temperature sensor 5 for detecting a water temperature of a cooling water outlet (a water jacket outlet) 13*b*.

The electric water pump 100 is disposed at a cooling water inlet 13*a* side of the engine 1. The electric water pump 100 includes a discharge port 101*b* coupled to the cooling water inlet 13*a* of the water jacket 13 of the engine 1. The cooling water outlet 13*b* of the water jacket 13 is coupled to both a cooling water inlet 2*a* of the heater core 2 and a cooling water inlet 3*a* of the radiator 3 through a head outlet passage 200*b*. The electric water pump 100 will be described in detail later.

The heater core 2 includes a cooling water outlet 2*b* coupled to a cooling water inlet 4*a* of the thermostat 4 through a heater outlet passage 202*b*. The radiator 3 includes a cooling water outlet 3*b* coupled to a cooling water inlet 4*b* of the thermostat 4 through a radiator outlet passage 201*b*. The thermostat 4 includes a cooling water outlet 4*c* coupled to a suction port 101*a* of the electric water pump 100 through a thermo outlet passage 200*c*. At a discharge side of the electric water pump 100, a pressure sensor 6 for detecting a discharge pressure of the electric water pump 100 is disposed. When hunting of discharge pressure described later occurs, this pressure sensor 6 can detect the hunting of discharge pressure. A position to dispose the pressure sensor 6 is not specifically limited. Any position may be possible insofar as the discharge pressure of the electric water pump 100 can be detected. For example, the position may be at the cooling water outlet 13*b* side of the water jacket 13.

The thermostat 4 is a publicly known temperature sensitive switching valve that is commonly used in this type of cooling apparatus, and has the following structure. The thermostat 4 in a closed state closes off the passage between the cooling water inlet 4*b* (a coupling port of the radiator 3) and the cooling water outlet 4*c*. The thermostat 4 in an open state couples the cooling water inlet 4*b* and the cooling water outlet 4*c* together.

Specifically, the thermostat 4 is a valve device that includes a temperature-sensing portion, which changes a position of a valve body, and is actuated by expansion and contraction of a thermowax in the temperature-sensing portion. In the case where a water temperature of the cooling water is comparatively low, the thermostat 4 closes off a coolant passage between the radiator 3 and the electric water pump 100 (closes off a passage between the cooling water inlet 4*b* and the cooling water outlet 4*c*) so as not to allow the cooling water to flow into the radiator 3. On the other hand, after warming-up of the engine 1 is completed, that is, in the case where a temperature of the cooling water is comparatively high, the thermostat 4 opens (the cooling water inlet 4*b* communicates with the cooling water outlet 4*c*) corresponding to the water temperature so as to allow the cooling water to partially flows into the radiator 3.

The cooling water inlet 4*a* (a coupling port of the heater core 2) of the thermostat 4 is always in communication with the cooling water outlet 4*c*. The cooling water flowing from the cooling water inlet 4*a* toward the cooling water outlet 4*c* is brought into contact with the temperature-sensing portion.

The heater circulating system passage 202 is coupled to the heater core 2. The cooling water discharged from the electric water pump 100 circulates through "the water jacket 13 of the engine 1, the heater core 2, the thermostat 4, and the electric water pump 100" in this order. The heater core 2 is a heat exchanger for heating the inside of a passenger compartment using heat of the cooling water, and disposed facing a flow duct of an air conditioner. That is, during heating the inside of the passenger compartment (while the heater is ON), conditioned air that flows through the flow duct passes the heater core 2. Thus, the air is supplied to the inside of the passenger compartment as hot air. In another case (for example, during cooling) (while the heater is OFF), conditioned air bypasses the heater core 2.

—Electric Water Pump—

Figure 2:
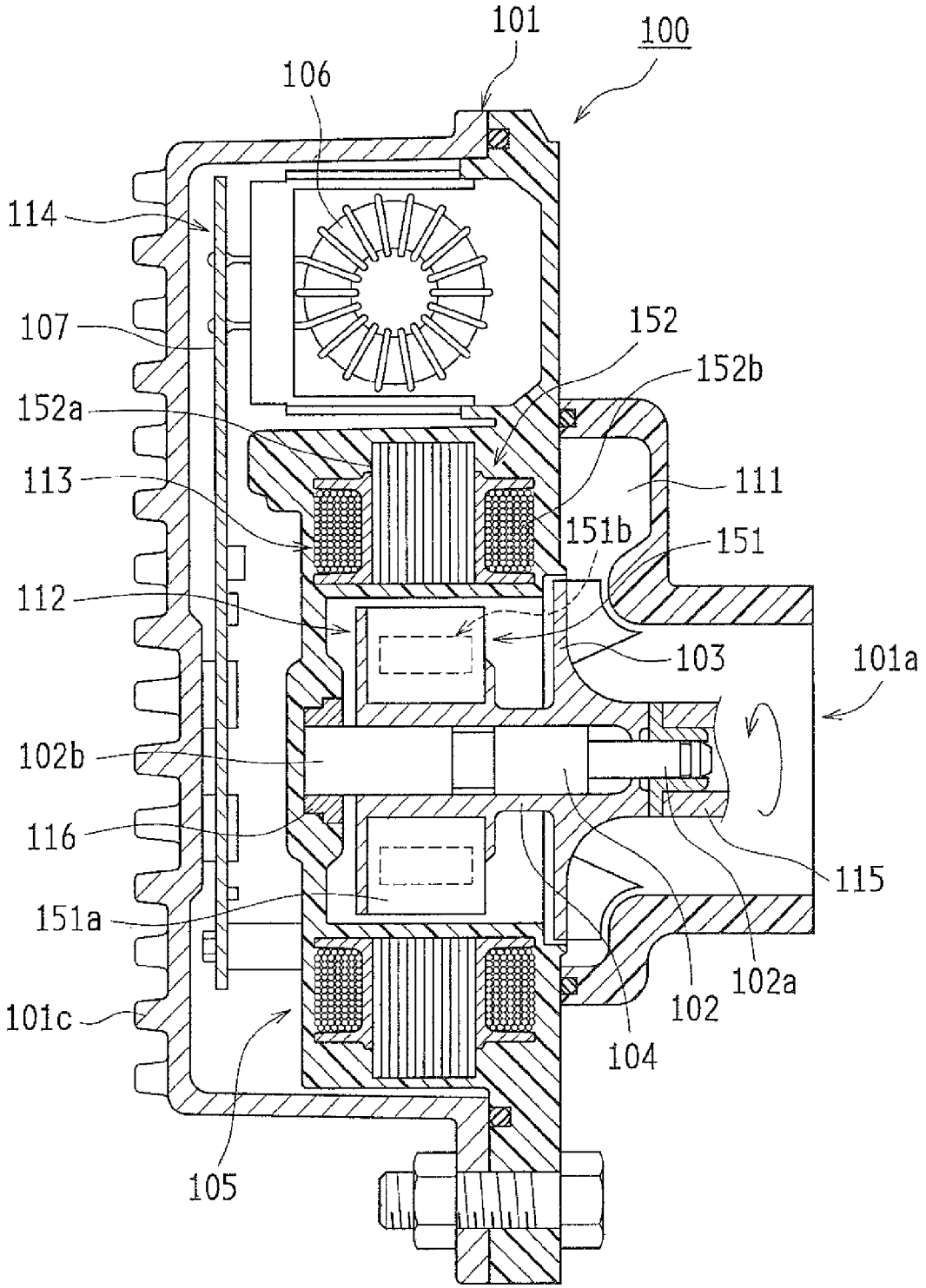
FIG. 2 is a vertical cross-sectional view illustrating an exemplary electric water pump to which the present invention is applied.

Next, the electric water pump 100 will be described by referring to FIG. 2.

The electric water pump 100 in this example is a centrifugal pump that includes a pump case 101, which constitutes a pump body, a support shaft 102, an impeller 103, a rotor shaft 104, an electric motor 105, and similar member. The impeller 103 feeds the cooling water under pressure. The electric motor 105 includes a rotor 151 and a stator 152.

In the pump case 101, a swirl chamber 111, a rotor housing portion 112, a stator housing portion 113, a control device housing portion 114, and similar portion are formed. The rotor housing portion 112 partially communicates with the swirl chamber 111. Loading the cooling water into the electric water pump 100 allows the cooling water to flow into the rotor housing portion 112. Here, a heat radiating fin 101*e* is formed on a back side of the pump case 101.

The pump case 101 includes the suction port 101*a* in communication with the swirl chamber 111. The cooling water flows into the swirl chamber 111 through this the suction port 101*a*. The cooling water that has flown into the swirl chamber 111 receives pressure from the impeller 103 described later, and is fed under pressure to the water jacket 13 of the engine 1 through the discharge port 101*b* (see FIG. 1) of the pump case 101.

The support shaft 102 is disposed inside of the pump case 101 along the rotational center of the pump (the rotational center of the impeller 103). The support shaft 102 includes one end portion (a distal end portion) 102*a* supported by a supporting member 115. The supporting member 115 is integrally formed with the pump case 101. The support shaft 102 includes the other end portion (a rear end portion) 102*b* press-fitted into a bush 116 that engages the pump case 101. The support shaft 102 is secured to the pump case 101 so as not to rotate when the electric water pump 100 is driven.

The impeller 103 is housed in the swirl chamber 111 of the pump case 101. The impeller 103 is integrally formed with one end (a distal end) of the rotor shaft 104. The rotor shaft 104 is a cylindrical-shaped member, and rotatably supported by the support shaft 102. The following configuration is also possible. The impeller 103 and the rotor shaft 104 are provided as separate components. The impeller 103 is fixedly secured to the distal end of the rotor shaft 104.

The rotor shaft 104 is integrated with the rotor 151, which constitutes the electric motor 105. The rotor 151 includes, for example, a rotor core 151*a* and a permanent magnet (IPM: Interior Permanent Magnet) 151*b*. The rotor core 151*a* includes a plurality of laminated electromagnetic steel plates. The permanent magnet 151*b* is buried in the rotor core 151*a*. The stator 152, which constitutes the electric motor 105, includes a stator core 152*a* and coils 152*b* of phases to be energized. The stator core 152*a* includes a plurality of laminated electromagnetic steel plates. The coils 152*b* has three phases (U-phase, V-phase, and W-phase) wound around an outer circumference of the stator core 152*a*. The electric motor 105, which includes the stator 152 and the rotor 151, will be described later in detail.

The control device housing portion 114 of the pump case 101 houses an LC module, a control board 107, and similar member. The LC module includes, for example, a capacitor and an inductor (a reactor) 106.

In the electric water pump 100 with the above-described structure, energization to each coil 152*b* of the stator 152 (a switching control of the energized phase) is controlled to rotate the rotor 151 and the rotor shaft 104. The impeller 103 rotates in association with this rotation. With this rotation of the impeller 103, the cooling water is suctioned from the suction port 101*a* of the pump case 101 and flows into the swirl chamber 111. The cooling water that has flown into the swirl chamber 111 receives pressure from the impeller 103, and is fed under pressure from the discharge port 101*b* (see FIG. 1) to the cooling water inlet 13*a* of the engine 1. The drive control of the electric water pump 100 will be described later.

—ECU—

Next, an electronic control unit (ECU) 300 will be described.

The ECU 300 includes a central processing unit (CPU), a read only memory (ROM), a random access memory (RAM), a backup RAM, and similar member.

The ROM stores, for example, various control programs and maps referenced when the various control programs are executed. The CPU executes the various control programs stored in the ROM and arithmetic processes based on the maps. The RAM is a memory that temporarily stores results of the arithmetic operations in the CPU, data input from respective sensors, and similar data. The backup RAM is a non-volatile memory that stores data to be saved and similar data when the engine 1 is stopped.

The ECU 300 is coupled to various sensors for detecting an operating state of the engine 1. The various sensors include the water temperature sensor 5, an air flow meter for detecting an air intake amount, an intake air temperature sensor, an engine speed sensor (not shown), and similar sensor. The ECU 300 is coupled to the pressure sensor 6 for detecting a discharge pressure of the electric water pump 100.

The ECU 300 performs various controls for the engine 1 based on respective output signals of the various sensors for detecting the engine operating state. The various controls include an intake air amount control (a throttle valve position control) for the engine 1, a fuel injection amount control (a switching control for an injector), and similar control. The ECU 300 performs a drive control for an electric water pump 100.

The program executed by the above-described ECU 300 achieves the control device for the electric water pump of the present invention.

—Description of Operation of Cooling Apparatus—

Next, a flow of the cooling water of the cooling apparatus illustrated in FIG. 1 will be described by referring to FIG. 1 and FIGS. 3(*a*) to 3(*c*). In FIGS. 3(*a*) to 3(*c*), passages through which the cooling water flows and a flow direction of the cooling water are illustrated by solid lines with arrows while passages through which the cooling water does not flow are illustrated by dashed lines.

First, at low temperature (for example, at the time of cold start), the cooling water has a low water temperature. Thus, the thermostat 4 is in the closed state. In this example, in order to accelerate warming-up of the engine 1 at low temperature, the electric water pump 100 is stopped so as to stop circulation of the cooling water inside of the engine 1 (inside of the water jacket 13) (at the stop of water in the engine cooling system: in a state of FIG. 3(*a*)).

During this control for the stop of water in the engine cooling system, the ECU 300 monitors the water temperature of the cooling water inside of the engine 1 based on an output signal of the water temperature sensor 5. At the time the water temperature increases to a determination water temperature (a water temperature considering an overheat temperature of the engine 1) thw1 described later, the ECU 300 drives the electric water pump 100 such that the state transitions to a water circulation state. At this time, the state does not transition directly from the water stop state by stopping the electric water pump 100 to a water circulation state by a normal flow rate control for the electric water pump 100. An extremely low flow rate control described later is performed between the water stop state and the water circulation state. Performing the extremely low flow rate control circulates a slight amount of the cooling water through the heater circulating system passage 202. After performing this extremely low flow rate control for a predetermined time, the state is switched to the water circulation state (a state of FIG. 3(*b*)) by the normal flow rate control.

The water temperature of the cooling water increases inside of the heater circulating system passage 202 as time goes on. Subsequently, the water temperature of the cooling water becomes equal to or more than a predetermined temperature (equal to or more than an opening temperature of the thermostat 4) around the temperature-sensing portion of the thermostat 4. At this time, the thermostat 4 opens. Opening of the thermostat 4 allows the cooling water to partially flow into the radiator 3 as illustrated in FIG. 3(*c*). The heat recovered by the cooling water is dissipated into the atmosphere from the radiator 3.

—Drive Control of Electric Water Pump—

Figure 4A:
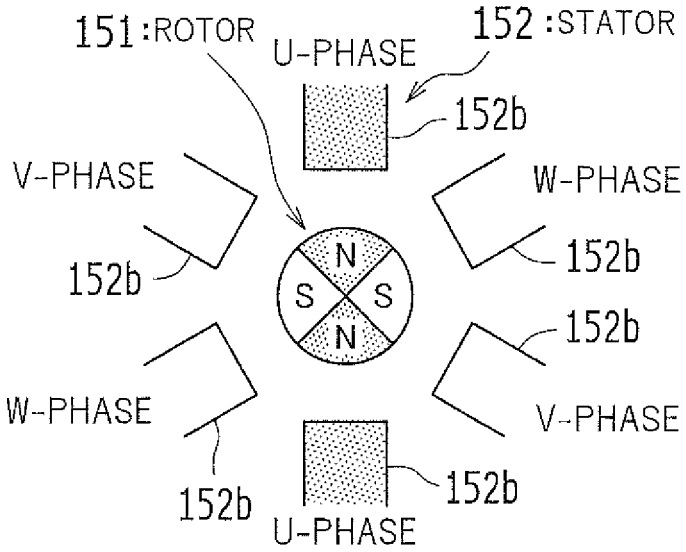
FIGS. 4(*a*) and 4(*b*) are conceptual diagrams each illustrating an exemplary arrangement of a rotor and stators (phases to be energized) in an electric motor.
Figure 4B:
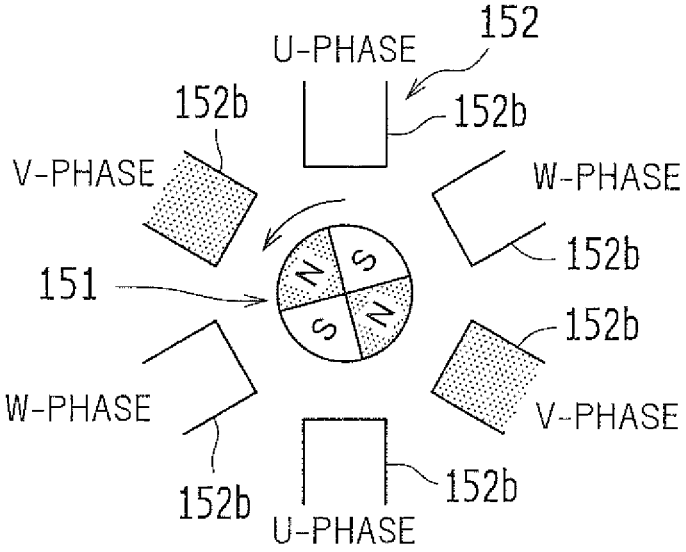

First, the electric motor 105 of the electric water pump 100 will be described. The electric motor 105 in this example is a three-phase four-pole brushless motor with a sensorless drive system. As illustrated in FIGS. 4(*a*) and 4(*b*), the electric motor 105 includes the four-pole rotor (a magnet rotor) 151 and the stator 152. The stator 152 includes coils 152*b*, which are the phases to be energized of the three phases (U-phase, V-phase, and W-phase) arranged at the periphery of the rotor 151.

In this three-phase four-pole electric motor 105, as illustrated in FIG. 4(*a*), only one phase to be energized (for example, the coil 152*b* of U-phase) is energized among the three phases to be energized (the coils 152*b* of the stator 152) at the start of motor driving such that the poles of the rotor 151 are aligned (the position of the rotor pole (N-pole) of the rotor is detected). Energization of each phase to be energized (each coil 152*b*) is sequentially switched from this state (to V-phase, W-phase, U-phase, V-phase . . . in this order) such that the rotor 151 rotates.

In this switching control for the energized phase, an electromotive force (an induced voltage) generated at a non-energized phase (the non-energized coil 152*b*) is used to detect a positional change of the rotor 151. A feedback control is performed such that a motor rotational speed (a rotational speed of the rotor 151 per unit time) obtained from this detected value becomes a target value (a required rotational speed). This feedback control is performed only during the normal flow rate control but is not performed during the extremely low flow rate control described later.

Furthermore, the electric motor 105 in this example can change the time interval to switch energization of the three phases (U-phase, V-phase, and W-phase) of the phases to be energized (the coils 152*b*). The energization for respective phases to be energized (the coils 152*b*) is controlled by duty control. Also, an energization duty ratio for each energized phase can be changed within a range from 0 to 100%.

The ECU 300 performs these drive controls (controls for the time interval to switch the energized phase, the energization duty ratio for each energized phase, and similar parameter) of the electric motor 105 (the electric water pump 100).

—Extremely Low Flow Rate Control—

Next, the extremely low flow rate control for the electric water pump 100 will be described.

As described above, in the control for the stop of water in the engine cooling system, in the case where the electric water pump 100 is driven by the normal flow rate control at the transition from the water stop state to the water circulation state, the cooling water at low temperature flows into the engine 1 (into the water jacket 13). This rapidly reduces the water temperature inside of the engine 1 (see dashed lines in FIG. 8). This causes heat shock and reduction in fuel efficiency. Simply providing an extremely low flow rate state between the water stop state and the water circulation state solves these problems. However, with the conventional control, the extremely low flow rate control for the electric water pump 100 cannot be performed for the following reason.

Figure 9:
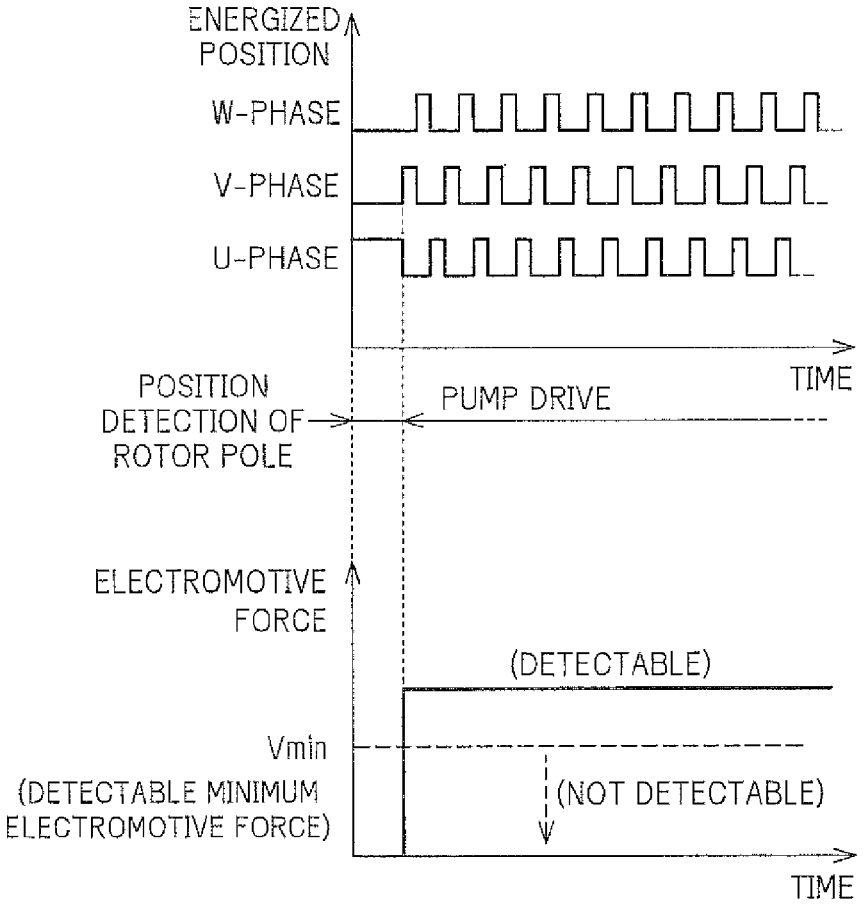
FIG. 9 is a timing chart illustrating an exemplary drive control for a conventional electric water pump.

First, also in the conventional control, as illustrated in FIG. 4(*a*) and FIG. 9, only one phase to be energized (for example, U-phase) is energized among the three phases to be energized (coils) at the start of motor driving such that the pole positions of the rotor 151 are aligned (the pole positions of the rotor is detected). Energization of each phase to be energized (each coil) is sequentially switched from this state (to V-phase, W-phase, U-phase, V-phase . . . in this order) such that the rotor 151 rotates. In this switching control for the energized phase, an electromotive force generated at a non-energized phase (the non-energized coil 152*b*) is detected to determine whether or not the rotor 151 (the electric water pump) rotates as required.

Figure 10:
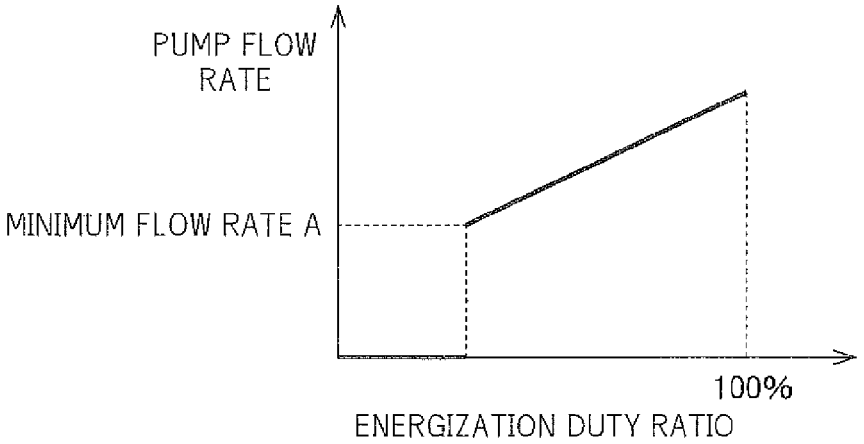
FIG. 10 is a graph illustrating the minimum flow rate in the drive control for the conventional electric water pump.

However, in this conventional control, in the case where a speed (a speed of a magnetic flux of the rotor 151 to cut the coil 152*b*) of the rotor pole (N-pole or S-pole) passing the non-energized phase (the coil 152*b*) is slow since the rotor 151 rotates slowly, an electromotive force generated at the non-energized phase becomes small. Therefore, the rotor rotation (the motor rotation) cannot be accurately detected. Specifically, as illustrated in FIG. 9, in the case where the rotor speed is lower than the minimum detection electromotive force Vmin, the rotor speed cannot be accurately detected. Therefore, it cannot be determined whether or not the rotor 151 (the electric water pump) rotates at the required rotational speed. Thus, a pump flow rate of the electric water pump cannot be set to a smaller flow rate than the minimum flow rate A (for example, 10 L/min) equivalent to the detectable minimum electromotive force Vmin (see FIG. 10).

To solve this point, in this embodiment, the discharge pressure of the electric water pump 100 is used to perform rotation determination for the electric water pump 100. This allows normal determination of the electric water pump 100 in a low rotor rotation range where the electromotive force generated at the non-energized phase is not detectable. The specific determination control will be described by referring to FIGS. 4(*a*) and 4(*b*) to FIG. 6.

Figure 5:
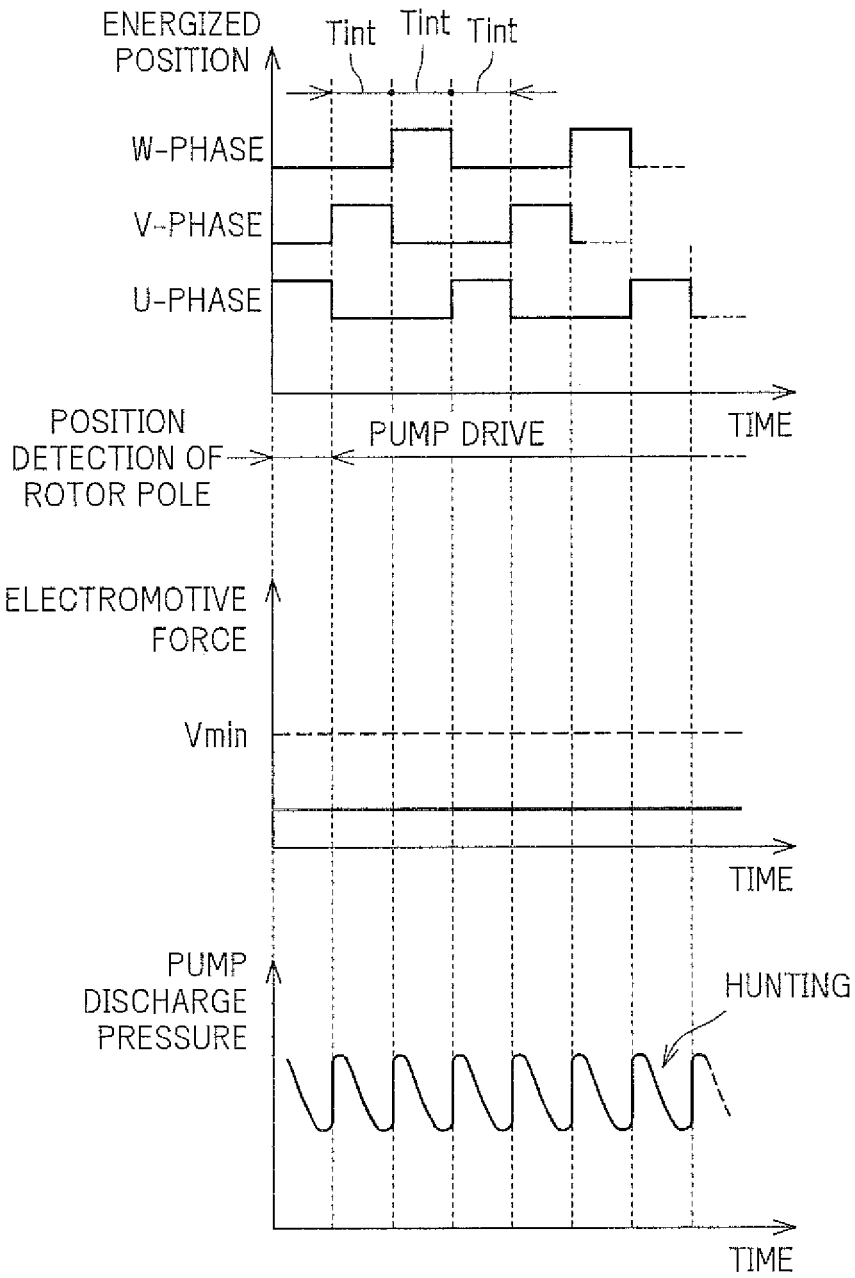
FIG. 5 is a timing chart illustrating an exemplary drive control for the electric water pump of the present invention.

First, as illustrated in FIG. 4(*a*) and FIG. 5, only one phase to be energized (for example, the coil 152*b* of U-phase) is energized among the three phases to be energized (the coils 152*b* of the stator 152) at the start of motor driving such that the pole positions of the rotor 151 are aligned (the pole positions of the rotor are detected). The rotor 151 is rotated by switching the energized phase from this state (FIG. 4(*a*), FIG. 4(*b*) . . . in this order). In this embodiment, a time interval Tint (see FIG. 5) to switch the energized phase is set sufficiently larger (for example, 1 sec) than that during the normal flow rate control (for example, on the order of msec) so as to rotate the rotor 151 (the electric water pump 100) at an extremely low rotational speed. This achieves circulation of the cooling water at an extremely low flow rate.

Here, in the electric water pump 100 that includes the electric motor 105 rotated by switching the energized phase, in the case where the electric water pump 100 actually rotates corresponding to a rotation request as described above, there appears a phenomenon where a pump discharge pressure repeatedly increases and decreases (hunting of the discharge pressure). On the other hand, in the case where the rotor 151 (the pump) does not rotate despite receiving the drive request, hunting of the discharge pressure does not occur.

Regarding the hunting of the discharge pressure, a hunting cycle becomes longer as the time interval Tint to switch the energized phase becomes larger. Therefore, hunting of the pump discharge pressure is likely to be easily recognized. This allows recognizing the hunting of the discharge pressure even in the case where the time interval Tint to switch the energized phase is set sufficiently longer (the rotor speed is set sufficiently lower) than that during the normal flow rate control. This allows recognizing existence of the hunting of the discharge pressure even in an extremely low rotor rotation range where the electromotive force generated at the non-energized phase of the electric motor 105 becomes equal to or less than the detectable minimum electromotive force (the minimum electromotive force generated at the non-energized phase) Vmin as illustrated in FIG. 5. In the case where the hunting of the discharge pressure occurs, it can be determined that the electric water pump 100 properly rotates as required. On the other hand, in the case where the hunting of the discharge pressure does not occur, the electric water pump 100 can be determined to be abnormal.

Figure 6:
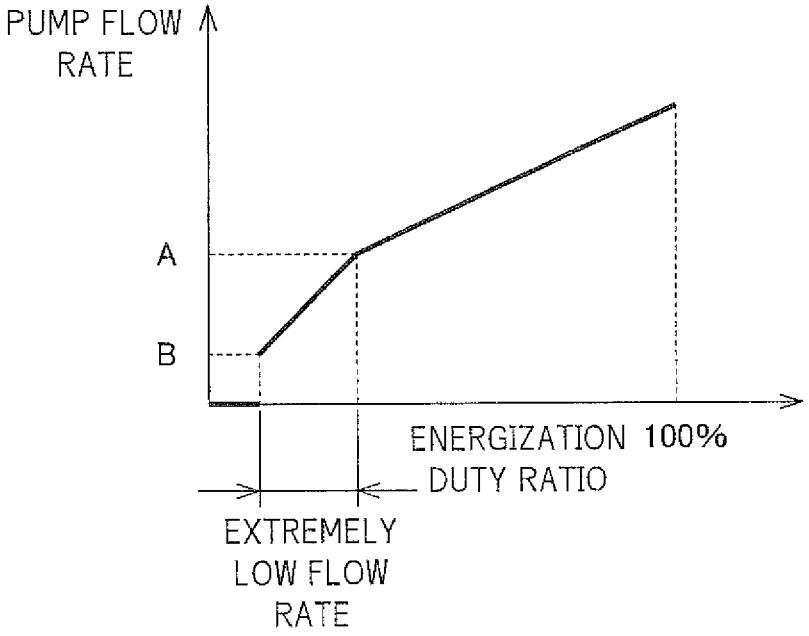
FIG. 6 is a graph illustrating a region of an extremely low flow rate achieved by the drive control for the electric water pump of the present invention.

Accordingly, in this embodiment, it can be determined whether or not the electric water pump 100 normally rotates as required in the low rotor rotation range (a rotor rotation range equal to or less than the minimum duty ratio (for example, 40%) controllable by the conventional control) where the electromotive force generated at the non-energized phase is not detectable. As illustrated in FIG. 6, this allows the cooling water to circulate at an extremely low flow rate B (for example, 2 L/min) that is lower than the minimum flow rate A (for example, 10 L/min) controllable by the conventional control.

—Control Example (1) for Electric Water Pump—

Next, an exemplary drive control for the electric water pump 100 will be described by referring to a flowchart of FIG. 7. This control routine of FIG. 7 is executed by the ECU 300.

Figure 7:
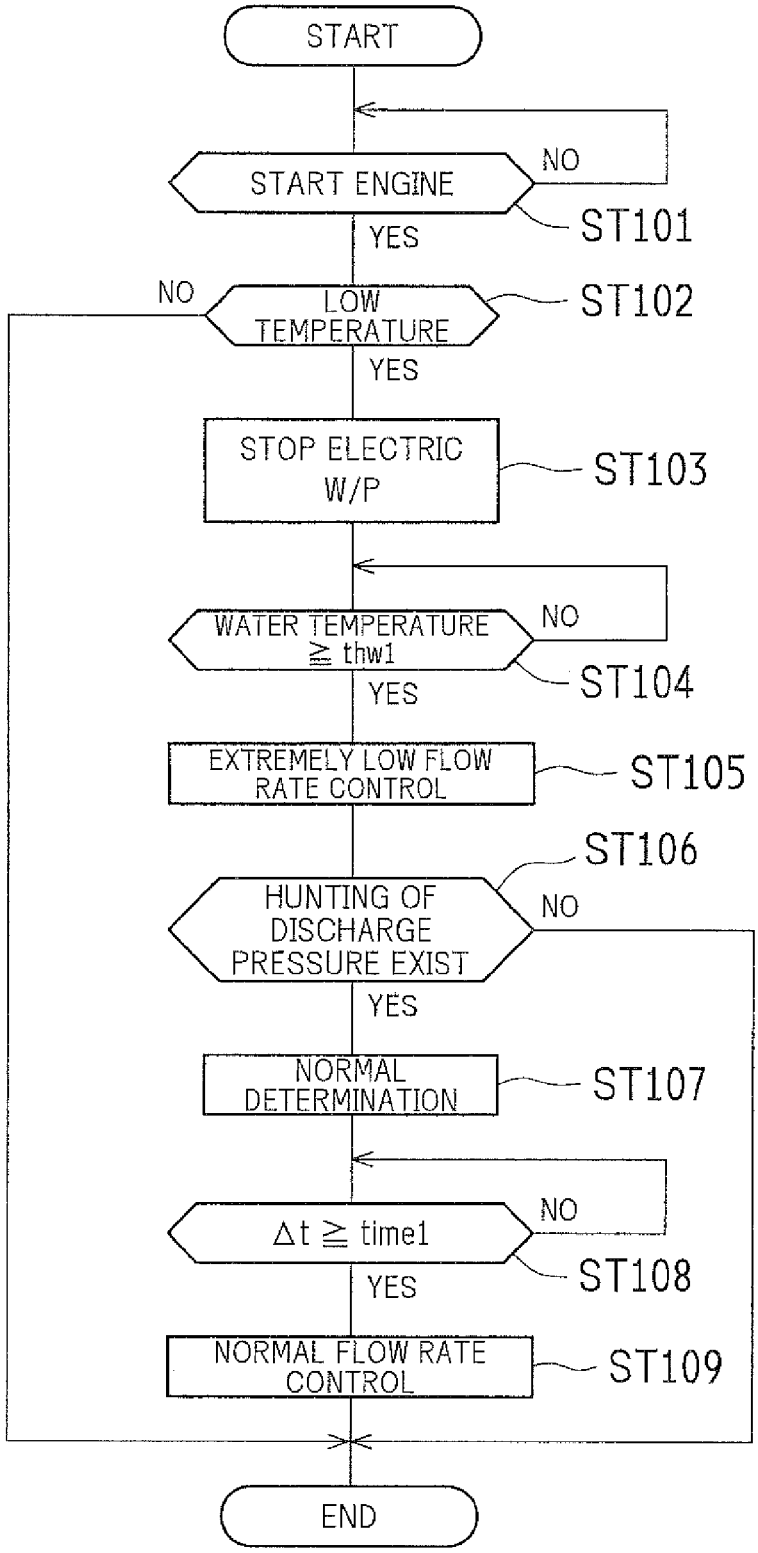
FIG. 7 is a flowchart illustrating an exemplary drive control for the electric water pump performed by an ECU.

The control routine illustrated in FIG. 7 starts at the time an engine start request was made. When the control routine of FIG. 7 starts, first, in step ST101, it is determined whether or not the engine 1 starts based on an output signal of the engine speed sensor. At the time the engine 1 starts (at the time an affirmative determination (YES) is made in step ST101), the process proceeds to step ST102.

In step ST102, it is determined whether or not a temperature is low based on an output signal of the water temperature sensor 5. In the case where a negative determination (NO) is made as a determination result, the process is terminated. In the case where an affirmative determination (YES) is made as a determination result in step ST102, the process proceeds to step ST103. In this step ST102, it is determined "the temperature is low" in the case where a water temperature of the cooling water obtained from the output signal of the water temperature sensor 5 is equal to or less than a predetermined value (for example, 70° C.).

In step ST103, the stop state of the electric water pump (the electric W/P) 100 is maintained. Subsequently, in step ST104, it is determined whether or not the current water temperature of the cooling water is equal to or more than the predetermined determination temperature thw1. The current water temperature of the cooling water is obtained from the output signal of the water temperature sensor 5.

In the case where a negative determination (NO) is made as a determination result in step ST104 (in the case where the water temperature<thw1), the electric water pump 100 maintains the stop state. As time goes on since the engine starts, the water temperature of the cooling water increases inside of the engine 1 (inside of the water jacket 13). At the time the water temperature (recognized based on the output signal of the water temperature sensor 5) reaches the determination temperature thw1 (at the time the water temperature≥thw1 is satisfied and an affirmative determination (YES) is made in step ST104), the process proceeds to step ST105.

The period until the affirmative determination (YES) is made in step ST104 as described above, that is, the period until the water temperature reaches the determination temperature thw1 from the start of the engine is a period for the stop of water in the cooling system where the electric water pump 100 is stop not to circulate the cooling water in the engine 1.

Here, the determination temperature thw1 used for the determination process in step ST104 is set to an appropriate value by an experiment, a simulation, and similar method considering the overheat temperature of the engine 1. In this example, the determination temperature thw1 is set to, for example, 80° C. The determination temperature thw1 may be set to a value other than "80° C.".

The current water temperature used for the determination in step ST104 may employ an estimated water temperature (an estimated water temperature of the cooling water inside of the cylinder block 11 or the cylinder head 12) estimated based on a water temperature of the cooling water at the start of the engine, an integrated value of the air intake amount from the start of the engine, and similar parameter.

In step ST105, the electric water pump 100 is driven by the extremely low flow rate control. Specifically, as illustrated in FIG. 4(*a*), first, only one phase to be energized (for example, U-phase) is energized among the phases to be energized (the coils 152*b*) of the three phases (U-phase, V-phase, and W-phase) to detect the pole positions of the rotor. In this state, the energized phase is switched to rotate the rotor 151 (the electric water pump 100). At this time, as described above, the time interval to switch the energized phase is set sufficiently long (for example, 1 sec) such that the rotor 151 (the electric water pump 100) rotates at an extremely low rotational speed. When this extremely low flow rate control in step ST105 is performed, the ECU 300 starts measuring an elapsed time Δt from the start of the extremely low flow rate control. In the extremely low flow rate control, the energization duty ratio for each phase is set to a constant value (for example, a value equal to or less than 40%).

In step ST106, it is determined whether or not the hunting of the discharge pressure occurs as illustrated in FIG. 5 based on the output signal of the pressure sensor 6. In the case where an affirmative determination (YES) is made as a determination result in step ST106, it is determined that the electric water pump 100 rotates normally as required (a normal determination in step ST107), and the process proceeds to step ST108. On the other hand, in the case where a negative determination (NO) is made as a determination result in step ST106 (in the case where the hunting of the discharge pressure does not occur), the process is terminated. In the case where the hunting of the discharge pressure does not occur, it is determined that the electric water pump 100 is abnormal. For example, a malfunction indicator lamp (MIL) is turned on to urge the user to have, for example, the vehicle checked and repaired by a dealer or similar.

In step ST108, it is determined whether or not the elapsed time Δt from the start of the extremely low flow rate control becomes larger than a predetermined determination value time1. For example, this determination value time1 is set considering the time until the cooling water inside of the engine 1 (inside of the water jacket 13) and the cooling water inside of a piping system (including the heater core 2 and similar member) of the cooling water circulation passage 200 are mixed by the extremely low flow rate control to have similar water temperatures (or within a range of an allowable temperature difference).

In the case where a negative determination (NO) is made as a determination result in step ST108 (in the case where Δt<time1 is satisfied), the extremely low flow rate control of the electric water pump 100 continues. At the time the elapsed time Δt from the start of the extremely low flow rate control reaches the determination value time1 (at the time Δt≥time1 is satisfied and an affirmative determination (YES) is made in step ST108), the process proceeds to step ST109. In step ST109, the control of the electric water pump 100 is switched from the extremely low flow rate control to the normal flow rate control (switched to the water circulation state).

The normal flow rate control performed in step ST109 is the following control for example. This control refers to a map (a map during a normal control) based on an operating state of the engine 1 to obtain a required flow rate. Based on the required flow rate, the rotational speed of the electric water pump 100 is set.

As described above, the control in this example can determine whether or not the electric water pump 100 normally rotates in the low rotor rotation range where the electromotive force generated at the non-energized phase is not detectable. This ensures the extremely low flow rate control that is impossible by the conventional control. Accordingly, the control for the stop of water in the engine cooling system can provide the extremely low flow rate state between the water stop state and the water circulation state. As a result, this effectively reduces heat shock during the transition from the water stop state to the water circulation state and maintains a large effect in fuel efficiency.

—Control Example (2) for Electric Water Pump—

Next, another example of the drive control for the electric water pump 100 will be described by referring to FIG. 8.

Figure 8:
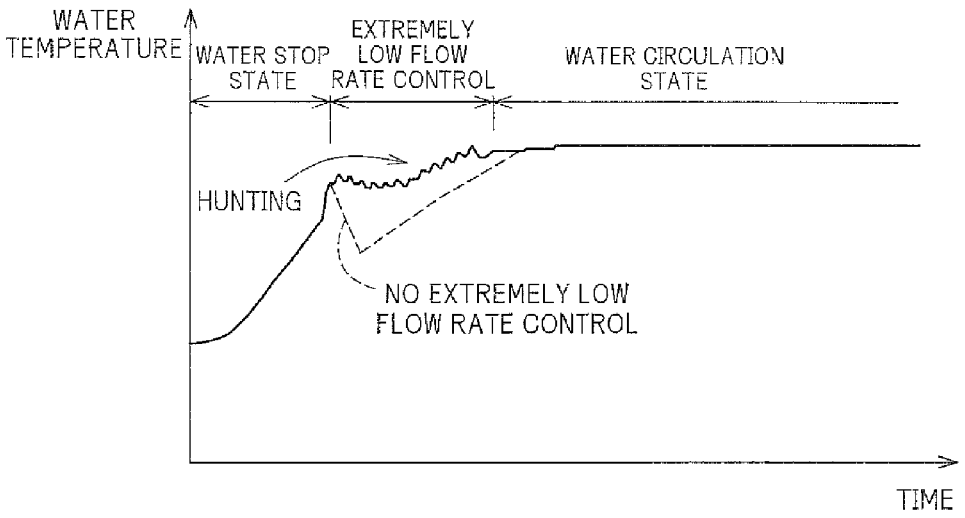
FIG. 8 is a graph illustrating a change of a water temperature from an engine start.

Also in this example, in the case where the engine starts at a low temperature, the electric water pump 100 is stopped in the water stop state (see FIG. 8). In this water stop state, a water temperature of the cooling water increases inside of the engine 1 (inside of the water jacket 13) as time goes on. At the time the water temperature (recognized based on the output signal of the water temperature sensor 5) reaches the determination temperature thw1, the electric water pump 100 is driven by the extremely low flow rate control. In this extremely low flow rate control, as illustrated in FIG. 8, hunting of the water temperature occurs. In the hunting of the water temperature, the water temperature repeatedly rises (increases) and falls (decreases). The reason will be described as follows.

First, when the electric water pump 100 is driven in the water stop state, cold cooling water from the outside of the engine 1 flows into cooling water at a high temperature inside of the engine 1 (inside of the water jacket 13). At this time, in the case where the flow rate of the electric water pump 100 is an extremely low flow rate, the hunting of the pump discharge pressure causes variation in flow rate of the cooling water (the cold cooling water) flowing into the engine 1. Thus, the water temperature inside of the engine 1 repeatedly falls (decreases) and rises (increases) (see FIG. 8). This hunting of the water temperature can also be recognized by a similar reason to the case of the hunting of the discharge pressure.

In this example, this point (the hunting phenomenon of the water temperature) is used to determine whether or not the hunting of the water temperature occurs in the extremely low flow rate control (determined in step ST106 in the flowchart of FIG. 7) based on the output signal of the water temperature sensor 5. In the case where the hunting of the water temperature occurs, it is determined that the electric water pump 100 normally rotates as required. On the other hand, in the case where the hunting of the water temperature does not occur in the extremely low flow rate control, it is determined that the electric water pump 100 is abnormal.

In the control of this example, the state is also switched from the extremely low flow rate control state to the water circulation state by the normal flow rate control at the time the elapsed time Δt from the start of the extremely low flow rate control reaches the determination value time1. That is, in the flowchart of FIG. 7, similar processes are performed except changing the determination process in step ST106.

As described above, the control of this example can also determine whether or not the electric water pump 100 normally rotates in the low rotor rotation range where the electromotive force generated at the non-energized phase of the electric motor 105 is not detectable. This ensures the extremely low flow rate control that is impossible by the conventional control. Accordingly, the control for the stop of the engine cooling system can provide the extremely low flow rate state between the water stop state and the water circulation state. As a result, this effectively reduces heat shock during the transition from the water stop state to the water circulation state and maintains a large effect in fuel efficiency.

—Other Embodiments—

The present invention is not limited to the electric water pump used for the engine cooling apparatus with the configuration illustrated in FIG. 1, and also applicable to the electric water pump in the engine cooling apparatus with another configuration.

For example, an engine cooling apparatus (generally referred to as a dual cooling apparatus) circulates cooling water through a water jacket (a head-side water jacket) of a cylinder head and a water jacket (a block-side water jacket) of a cylinder block in parallel. In this engine cooling apparatus, supply of the cooling water to the block-side water jacket is stopped (the water in the block is stopped) at low temperature. The present invention is also applicable to an electric water pump used in this type of engine cooling apparatus.

INDUSTRIAL APPLICABILITY

The present invention is used for control of an electric water pump that circulates cooling water through an engine (an internal combustion engine) mounted on a vehicle or similar.

DESCRIPTION OF REFERENCE SIGNS

1 engine
11 cylinder block
12 cylinder head
13 water jacket
5 water temperature sensor
6 pressure sensor
100 electric water pump
101*a* suction port
101*b* discharge port
103 impeller
104 rotor shaft
105 electric motor
151 rotor
152 stator
152*a* stator core
152*b* coil
200 cooling water circulation passage
201 radiator circulating system passage
202 heater circulating system passage
300 ECU

The invention claimed is:

1. A control device for an electric water pump that circulates cooling water through a cooling system of an engine, the control device comprising:

a rotation determining unit configured to determine that the electric water pump rotates as required by detecting that one of a discharge pressure of the electric water pump and a water temperature of the cooling water repeatedly increases and decreases when a rotation speed of the electric water pump is lower than a minimum detectable rotation speed, wherein the minimum detectable rotation speed is a minimum rotation speed at which a detectable electromotive force is generated at a non-energized phase by rotation of the electric water pump.

2. The control device for the electric water pump according to claim 1, wherein the rotation determination of the electric water pump is performed when a circulation flow rate of cooling water by the electric water pump is equal to or less than a predetermined flow rate.

3. The control device for the electric water pump according to claim 1, wherein energization of the electric water pump is controlled by duty control, and the rotation determination of the electric water pump is performed in a case where a duty ratio of the duty control is equal to or less than a predetermined value.

4. The control device for the electric water pump according to claim 1, wherein the electric water pump includes (i) a rotor having an impeller, and (ii) a stator having a plurality of phases of coils disposed at a periphery of the rotor, the electric water pump being configured to rotate the rotor by sequentially switching a phase to be energized, among the plurality of phases, in the coils of the stator, when the electric water pump transitions from a stopped state to a water circulation state, the electric water pump first enters a low flow rate state before entering a normal flow rate state, the low flow rate state being defined as a state in which the rotation speed of the electric water pump is lower than the minimum detectable rotation speed, and a time interval for sequentially switching energization of the plurality of phases during the low flow rate state is set to be longer than a time interval for sequentially switching energization of the plurality of phases during the normal flow rate state, such that the rotation determination of the electric water pump is performed.

5. The control device for the electric water pump according to claim 4, wherein the time interval for switching energization of the plurality of phases is set longer to an extent that a phenomenon occurs, the phenomenon being one of a discharge pressure of the electric water pump and a water temperature of the cooling water repeatedly increasing and decreasing.

* * * * *